United States Patent [19]

Hunter

[11] Patent Number: 4,815,662

[45] Date of Patent: Mar. 28, 1989

[54] STREAM PROPELLED ROTARY STREAM SPRINKLER UNIT WITH DAMPING MEANS

[76] Inventor: Edwin J. Hunter, 5551 Codorniz Rd., Rancho Santa Fe, Calif. 92067

[21] Appl. No.: 123,944

[22] Filed: Nov. 23, 1987

[51] Int. Cl.[4] ..... B05B 3/02; B05B 15/10

[52] U.S. Cl. ..... 239/222.17; 239/205; 239/206; 239/252; 239/DIG. 1

[58] Field of Search ..... 239/DIG. 1, 97, 203–206, 239/214, 237, 222.11, 222.17, 228, 231, 251, 252

[56] References Cited

U.S. PATENT DOCUMENTS

| | | | |
|---|---|---|---|
| 3,006,558 | 10/1961 | Jacobs | 239/222.17 X |
| 3,052,574 | 9/1962 | Kennedy, Jr. | 239/252 X |
| 3,854,664 | 12/1974 | Hunter | 239/206 |
| 4,440,345 | 4/1984 | Figwer et al. | 239/252 X |
| 4,471,908 | 9/1984 | Hunter | 239/DIG. 1 X |
| 4,660,766 | 4/1987 | Nelson et al. | 239/222.17 |

*Primary Examiner*—Andres Kashnikow
*Assistant Examiner*—Mary Beth O. Jones
*Attorney, Agent, or Firm*—Baker, Maxham & Jester

[57] ABSTRACT

A rotary stream sprinkler unit comprises a body having a water flow passage in which is disposed a flow control unit having one or more passages configured to control the volume and pressure of a stream which strikes and rotates a rotary distributor head rotatably mounted at the outlet of the housing for dividing each stream into a plurality of final streams and rotating each of the final streams through a selected arc during the rotation of the rotary head with a damping device connected to the rotary head for controlling the rotational velocity thereof.

15 Claims, 2 Drawing Sheets

STREAM PROPELLED ROTARY STREAM SPRINKLER UNIT WITH DAMPING MEANS

BACKGROUND OF THE INVENTION

The present invention relates to sprinkler units, and pertains particularly to a rotary stream sprinkler unit.

In my prior U.S. Pat. No. 3,854,664, issued Dec. 17, 1974, and, entitled "Sprinkler Systems", I disclose a sprinkler unit which has a rotating head that directs a plurality of rotating streams over an area to be watered. In that prior device, the streams of water are formed in nozzles in the rotating head. The rotating head has inlets to the nozzle on one end which engages and cooperates with an orifice plate for acting as a valve for controlling communication of pressurized water to the nozzles.

My U.S. Pat. No. 4,471,908 issued Sept. 18, 1984 and entitled "Pattern Sprinkler Head" discloses a similar sprinkler unit having V-shaped nozzles in a cylindrical rotating head. The nozzle inlet openings cooperate with an orifice in an orifice plate to vary the nozzle openings to the source of pressurized water. This combination delivers streams of water of variable length and volume from the nozzles in the distributor head. The orifice opening in the plate defines the spray pattern to be produced by the streams issuing from the nozzles in the rotating head.

In a subsequent application co-pending herewith, a plurality of passages in the unit forms nozzles which controls the stream size and velocity delivered to an open channel distributing head. The streams from the nozzles are directed into a plurality of open channels on a rotating distributor head for forming and distributing the streams.

The rotating head in the above described units is driven by a turbine through a reduction drive gear assembly within the body of the sprinkler unit. Such construction is complex and expensive to manufacture.

Sprinkler heads have been known wherein the distributor head is self-propelling, or more particularly stream propelled. The sprinkler head is rotated either by streams of water flowing from jets or nozzles in the head or by blades on the head struck by a stream of water, causing it to rotate.

Among the problems of the prior art self-propelled device is that it is difficult to control the velocity of rotation of the head. The velocity of rotation of the head is affected by friction, stream pressure and velocity, and other factors which ultimately determine the reach or distance that the distributed water travels from the head. The higher the velocity of rotation of the head, the shorter the reach of the streams from the head will be.

Some attempts have been made in the past to control the velocity of rotation of the distributor head by some type of damping means. However, these attempts have been unsatisfactory.

Accordingly, it is desirable that an improved rotary stream sprinkler unit be available.

SUMMARY AND OBJECTS OF THE INVENTION

It is therefore the primary object of the present invention to provide an improved rotary stream sprinkler unit.

In accordance with the primary aspect of the present invention, a rotary stream sprinkler unit comprises a housing having one or more stream nozzles for providing a predetermined stream volume and velocity, with a multiple channel rotor positioned at the outlet of the flow passages, rotating in response to the stream and for dividing the stream into a plurality of streams, and selectively distributing the streams over a predetermined area with an improved damping means for controlling the velocity of rotation of the head.

BRIEF DESCRIPTION OF THE DRAWINGS

The above and other objects and advantages of the present invention will become apparent from the following description when read in conjunction with the drawings wherein.

DETAILED DESCRIPTION OF A PREFERRED EMBODIMENT

Figure 1:
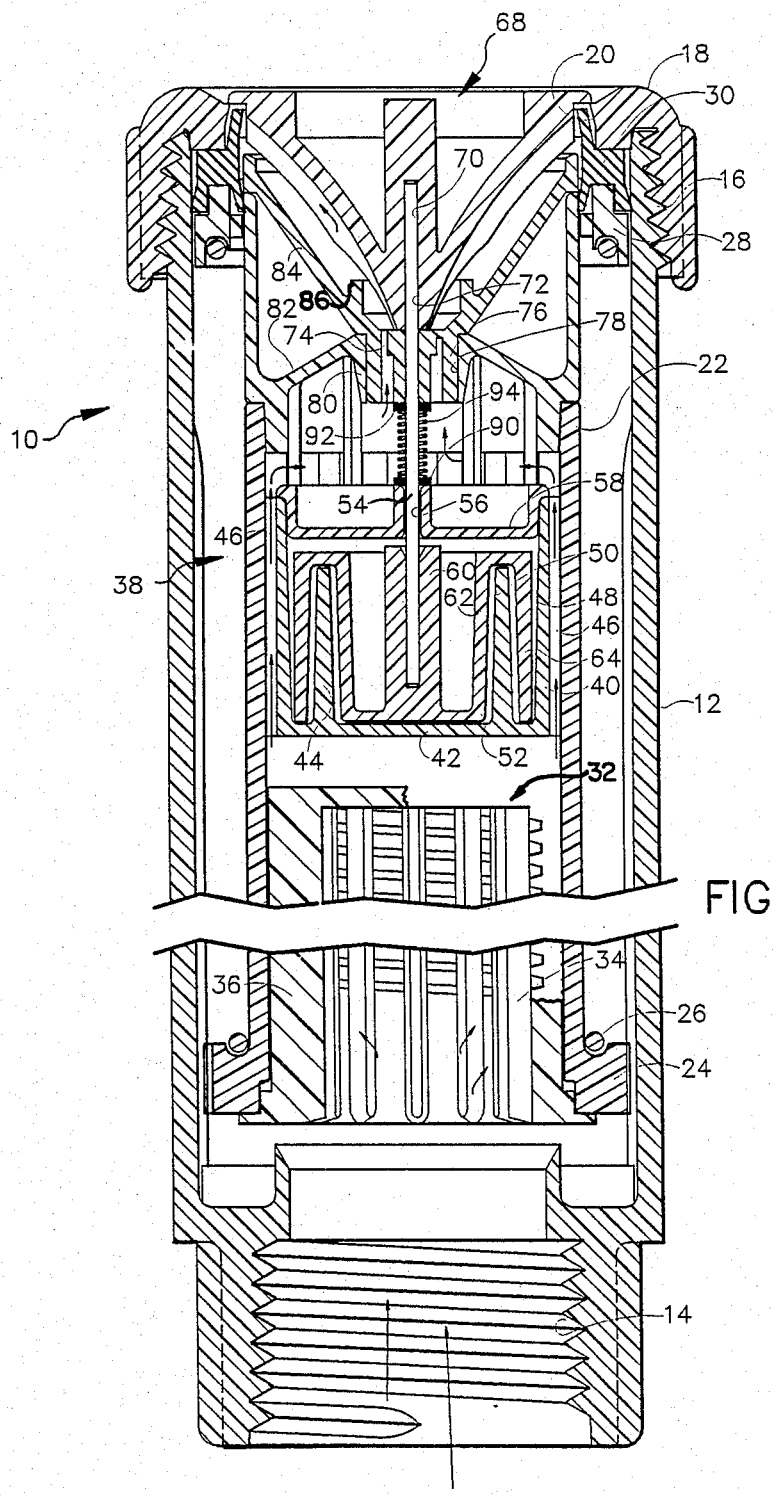
FIG. 1 is a side elevation view of a sprinkler unit in accordance with the invention.
Figure 2:
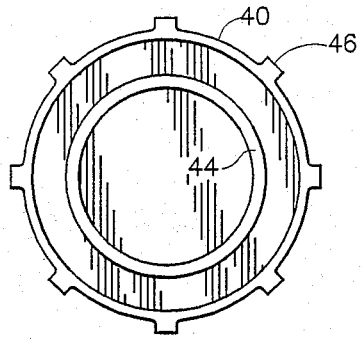
FIG. 2 is a top view showing the damping stator.
Figure 3:
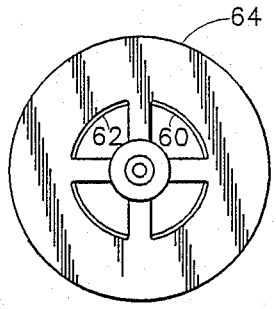
FIG. 3 is an end view of the damping rotor.

Referring to FIG. 1 of the drawings, there is illustrated a sprinkler unit constructed in accordance with a preferred embodiment of the invention. The sprinkler unit, designated generally by the numeral 10, comprises an elongated generally cylindrical tubular housing 12, having a threaded inlet port 14 at one axial end, which shall be termed the lower end attachable to a suitable source of water under pressure, such as a riser.

The opposite or upper end of the housing is open and is considered the outlet end thereof. The outlet end is provided with annular threads 16 for receiving a retainer ring or cap 18, as will be explained. The cap 18 has a central bore 20 for accommodating the telescopic extension of an inner tubular housing 22, which is telescopically and reciprocably mounted within the housing 12 for extension to an operative position and retraction to a non-operative position, as illustrated in FIG. 1.

The inner housing 22 includes a radially extending flange 24 at the lower end thereof, which extends outward and engages the interior surface of the wall of the outer housing 12, and also serves as a retainer for a retracting spring 26, which biases at its lower end against the flange 24 and its upper end against an annular ring 28. The ring 28 seats against a cup-shaped annular seal 30, which engages the outer surface of the inner housing 22 and is biased against retainer cap 18.

The driving and flow control structure for the sprinkler unit is mounted on and within the inner housing 22 and carried therewith as the housing is extended upward into the operative position. Mounted within the lower end of the inner housing 12, within the tubular central bore thereof, is a generally cylindrical screen 32 having radially extending ribs 34, forming a passageway 36 up to a damper unit 38 for controlling the velocity of the rotary nozzle, as will be explained.

The damper unit comprises a removable stationary housing or stator member, defined by a generally cylindrical housing member 40 having a closed end wall 42, and an inner axially extending annular wall 44 forming a tubular extension 44. The housing 40 includes radial ribs 46, which engages the inner surface of sleeve or inner housing 22 and forms a water flow passage around housing 22. The stator housing 40 thus forms a housing divided into a central cylindrical chamber 50 and an outer annular chamber 48.

Disposed within the stator member 40 is a rotor unit comprising a rotor drum 52 mounted on a rotating shaft 54, which is rotatably mounted within a bore 56 of a housing cap or closure member 58. The rotor is complementary to the housing with central hub 60 on the lower end of the shaft 54 and formed within a cylindrical portion 62 and having an outer sleeve 64 extending into the space or annular chamber 48 between walls 40 and 44 of the stator. The opposed cylindrical surfaces of the stator 40 and rotor 52 may have ribs for enhancing the drag of the rotor. The stator housing is filled with a suitable damping fluid, such as a viscous damping oil. The viscosity of the damping fluid may be selected to provide the desired damping.

The drive shaft 54 is drivingly connected at its lower end to the rotor 52 by any suitable means, such as splines, keys, press fitting or the like. The drive shaft 54 extends upward through a bore 72 in cylindrical member 76 and is connected at the upper end to a multiple channel distributing cap or head 68 by means of suitable securement in a bore 70. The shaft extends along the flow passage and is sealed in bores 56 and 72 by means of washer shaped seals 90 and 92, biased into sealing engagement by a spring 94 and water pressure within the flow passage.

The shaft 54 extends through a bore 72 in a cylindrical portion 76 flow control unit having one or a plurality of flow control nozzles or passages 74 therein. The flow control unit has a generally funnel shape, with a cylindrical portion 76 mounted in a bore 78 of tubular extension 80 of an extension 82 of the inner housing 22. A frusto-conical skirt 84 of the flow control unit form an extension of the unit and therefore forms retaining cap for the extension of inner housing 22. The axially extending cylindrical portion 76 is formed with threads, and threadably engages complementary threads in the bore 78 of cylindrical extension 80 at a threaded portion therein. Thus, flow control units having different shape and size nozzles can be selectively mounted in any one sprinkler unit.

The drive shaft 54 is sealed in bore 56 by an annular seal member 90, and in bore 72 by an annular seal 92. These seals are biased into sealing engagement with a sealing surface surrounding the respective bores by a coil compression spring 94 and water pressure within the contiguous flow passage through which the shaft extends. The seal 90 is essential in that it is to prevent entry of water into the damping chamber 48 and 50 where it will contaminate the damping fluid therein.

Figure 4:
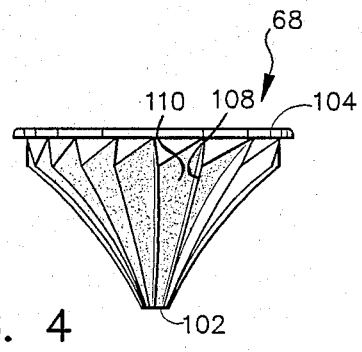
FIG. 4 is a side elevation view of the distributing head.
Figure 6:
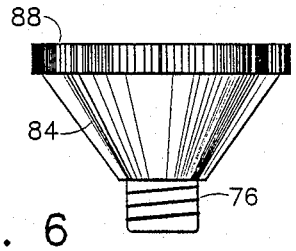
FIG. 6 is a side elevation view of the flow control unit.

The distributor head 68 is formed with a plurality of combined channels and turbine blades and serves the dual function of propelling itself and distributing streams of water over a surrounding area. The distributor head 68 has a somewhat curved or concave frusto-conical outer configuration. As can be seen in FIGS. 1 and 4, the outer surface of the distributor head curves slightly outward from the apex to the base of the cone. A plurality of curved channels or grooves 106 extend from the apex to the base of the head 68. These channels 106 all curve in the same direction around the axis, and each have a vertical wall 108 at the outside of the curve and a sloped wall 110 on the inside of the curve. These walls form combined flow channels and turbine blades.

One or more nozzles in unit 76, which will be futher explained hereinafter, delivers one or more streams of water to the apex end of distributing cap 68, which rotates in response thereto, and forms multiple streams and directs the streams of water by way of the plurality of flow channels radially outward from the sprinkler unit and rotates the streams through an arc. The streams of water issuing from nozzle 74 enter the channels 106 at the apex 102 and flow axially along and radially outward from the head 68.

The present sprinkler unit, as described above, is designed to distribute streams of water throughout a selected area. Water will be distributed on the side of the axis having nozzle 74. For example, the sprinkler unit has the capability, with proper nozzle configuration, of distributing streams of water over an area having a substantially rectangular shape. The sprinkler unit may be positioned in the center of the area to be covered or to one side thereof. The unit accomplishes this by means of the nozzle 74 in the unit 76, which controls the volume and velocity of portions of the primary flow stream to the distributor head 68, which forms and distributes each flow stream. The distributor head 68 has a plurality of curved channels for forming and rotating each stream across a particular arc or area of the plot determined by the location and shape of the nozzle 74. The action of the primary stream of water directed to the rotor or distributor head 68 also causes it to rotate. Thus, the distributor head 68 forms its own propelling turbine.

By way of example, a plot or area is covered by a plurality of individual streams directed outward at a particular angle from the sprinkler unit 10, and each covers a particular small arc or area of the plot, as will be explained with reference to the distributing cap.

Figure 5:
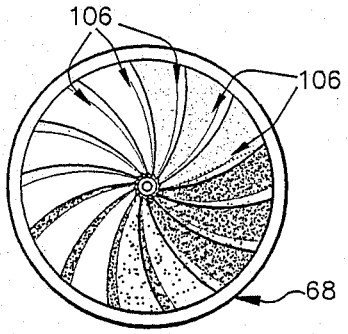
FIG. 5 is an end view of the distributor head.

An appreciation of the construction and operation of the distributor head will be obtained from a view of FIGS. 4 and 5 and the following explanation herein. As shown in FIGS. 4 and 5, the distributor cap has a generally horn or conical configuration, with a small diameter lower or inner end 102 and a larger diameter outer or top end 104, with a plurality of curved open water channels 106 extending therebetween. The water channels 106 each include an inlet end at the apex 104 and an outlet end at the base of the head, with a vertical sidewall 108 and a slope side wall 110 extending, as can be seen from FIG. 4, from a minimum depth at the inlet end 102 to a maximum minimum depth extending to the outlet 104. The channels 106 are curved such that the outlet end at 104 is at an angle to a radial through the axis of the distributor cap.

The channels thus form turbine blades that drive or rotate the distributor head 68 in response to one or more streams of water striking it from one or more nozzles or passage 74. An annular skirt 86 on the inside of conical member 84 aids in directing the flow of water into the channels 106. The channels 106 form a plurality of final streams from each arcuate stream directed thereto via passage 74. The distributor head, as can be seen in FIG. 1, sits directly over the flow nozzle 74, and the inner or lower ends of the channels 106 are disposed directly over the outlet of the flow passage or passages 74. It is nestled within a conical cavity formed by member 84.

Figure 7:
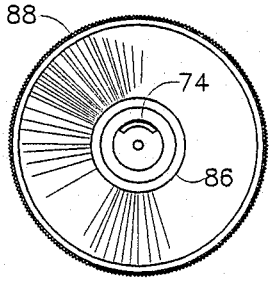
FIG. 7 is a top view of the flow control unit showing the flow control nozzle.

As will be appreciated from FIGS. 4 and 5, an outlet of a stream passage 74 is directed into the inner end of the flow channels 106, which causes rotation of the rotary distributor head 68. The rotation of the head directs the outer end of the flow stream along an arc at the end of its reach. A flow stream will have somewhat of an arc shape, as shown in FIG. 7, and is directed into the inner end at apex 102 of a plurality of the flow channels 106. The stream will continue to flow into a channel, with a rotation of the cap along an arc as long as the channel overlaps the passage or nozzle 74, as shown.

The length of the arc at the outer end of the stream will be determined by width of nozzle outlet 74, and the radius from the center axis of the rotor to the position of striking of the stream at its outer end. For example, a stream may extend outward anywhere from about five to about thirty feet, and the arc may vary at the outer end of the stream from approximately three feet in length up to as much as nine or ten feet in length. Thus, as the distributing cap is rotating, it maintains communication with the flow passage for a certain degree of rotation thereof. As long as the inner end of the flow channel is in communication with a particular nozzle or flow passage, a portion of the water from the flow passage will be directed along the flow channel 106, along an arc determined by where the inner end of the flow channel picks up the flow passage and where it drops that flow passage for the next one.

As the distributing cap rotates, a particular channel 106 will in sequence pick up and distribute flow from a flow passage 74, or the flow passage disposed around the flow control unit in sequence in the direction of rotation of the distributing cap. Thus, a portion of each primary flow stream will be in sequence picked up by a flow channel 106 as it registers with that stream, and will distribute it along an arc or direct it along an arc as the cap rotates. The length of the stream and its coverage of the surface area will be determined by the volume, velocity and other characteristics of the stream.

The damper unit will impose a drag on the distributor head so that it will maintain a reasonable velocity of rotation. A reasonably low rate of rotation will enable the streams from channels 106 to maintain a stream and attain a maximum reach. Means may be provided, such as knobs or the like, along the outer rim of the distributor head to extend into a few of the streams from the channels 106 to break up the streams and distribute water, inwardly toward the sprinkler unit.

While I have illustrated and described my invention by means of a specific embodiment, it is to be understood that numerous changes and modifications may be made therein without departing from the spirit and scope of the invention as defined in the appended claims.

I claim:

1. A rotating stream sprinkler unit comprising:

a tubular housing having a central axis, an inlet, an outlet, and a flow passage communicating therebetween for conducting a primary stream of water from said inlet to said outlet;

distributor means rotatably mounted at said outlet for receiving said primary stream of water, for rotating in response thereto, and for directing said stream outward from the axis of said housing over a selected area;

damping means disposed coaxially within said housing upstream of said outlet, and operatively connected to said distributor means for controlling the velocity of rotation thereof;

said damping means comprises a generally cylindrical chamber in said housing having annular wall means therein;

a quantity of damping fluid in said chamber;

a generally cylindrical rotor disposed in said chamber, including means defining an annular recess for receiving said annular wall means; and said rotor and said distributor head are connected by a coaxial shaft extending along said flow passage coaxially of said central axis.

2. A rotary stream sprinkler according to claim 1 wherein:

said distributor means comprises a distributor head having a plurality of curved axially and radially extending flow channels for defining turbine blades and for forming and directing a plurality of individual streams outward therefrom.

3. A rotary stream sprinkler according to claim 1 wherein:

said distributor head comprises a generally conical shaped member having a plurality of curved grooves extending along the conical surface thereof from the apex to the base thereof; and said apex is disposed at said outlet.

4. A sprinkler unit according to claim 1 wherein:

means for forming said stream of water comprises a body member mounted in said housing; and at least one substantially arcuate nozzle in said body member disposed in a circular arc and extending along said body member parallel to said central axis toward said outlet.

5. A rotary stream sprinkler unit comprising:

a tubular housing having a central axis, an inlet, an outlet, and a flow passage communicating therebetween for conducting a primary stream of water from said inlet to said outlet;

distributor means rotatably mounted at said outlet for receiving said primary stream of water and directing said stream outward from the axis of said housing over a selected area, said distributor means responsive to said primary stream for rotating; and damping means disposed in said flow passage operatively connected to said distributor means by a rotatable shaft extending along said passage for controlling the velocity of rotation thereof.

6. A rotary stream sprinkler according to claim 5 wherein:

said distributor means and said damping means are mounted on a common shaft coaxially of said central axis.

7. A rotary stream sprinkler according to claim 6 wherein:

said distributor means comprises a distributor head having a plurality of curved radially extending flow channels.

8. A rotary stream sprinkler according to claim 6 wherein:

said distributor head comprises a generally conical shaped member having a plurality of curved grooves extending along the conical surface thereof from the apex to the base threeof; and said apex is disposed at said outlet.

9. A sprinkler unit according to claim 8 wherein:

means for forming said stream of water comprises a body member mounted in said housing; and at least one substantially arcuate flow passage in said body member disposed in a circular arc and extending along said body member parallel to said central axis toward said outlet.

10. A sprinkler unit according to claim 9 wherein:

said damping means comprises a generally cylindrical chamber in said housing;

a quantity of damping fluid in said housing; and a generally cylindrical rotor disposed in said chamber.

11. A sprinkler unit according to claim 10 wherein:

said chamber includes annular wall means therein; and said rotor includes means defining an annular recess for receiving said annular wall means.

12. A rotary stream sprinkler unit comprising:

an elongated generally cylindrical housing having an axis and inlet and outlet means at opposite ends thereof;

a flow passage in said housing for communicating a fluid flow from said inlet to said outlet;

flow stream generating means comprising an elongated nozzle in said housing disposed radially outward from said axis at said outlet having a shape for generating a predetermined shaped flow stream at said outlet, said elongated passages having a length that is greater than the diameter;

combined turbine and distributor means rotatably mounted at said outlet for receiving said primary stream of water, for rotating in response thereto, and for directing said stream outward from the axis of said housing over a selected shaped area determined by said predetermined shape flow stream; and damping means in said flow passage operatively connected to said distributor means along said flow passage for controlling the velocity of rotation thereof.

13. A rotary stream sprinkler according to claim 12 wherein:

said distributor means comprises a generally conical shaped member having a plurality of curved grooves extending along the conical surface thereof from the apex to the base thereof; and said apex is disposed at said outlet.

14. A sprinkler unit according to claim 13 wherein:

means for forming said stream of water comprises a body member mounted in said housing; and at least one substantially arcuate flow passage in said body member disposed in a circular arc and extending along said body member parallel to said central axis toward said outlet.

15. A sprinkler unit according to claim 14 wherein:

said damping means comprises a generally cylindrical chamber in said housing;

a quantity of damping fluid in said housing; and a generally cylindrical rotor disposed in said chamber.

* * * * *